US010364647B2

(12) United States Patent
Sargent et al.

(10) Patent No.: US 10,364,647 B2
(45) Date of Patent: Jul. 30, 2019

(54) METHOD AND APPARATUS FOR CONTROLLING FLUID FLOW THROUGH A DOWN HOLE TOOL

(71) Applicant: TORSCH INC., Calgary (CA)

(72) Inventors: Shane Sargent, Calgary (CA); Matthew McCarthy, Calgary (CA); Sean Borschneck, Calgary (CA)

(73) Assignee: TORSCH INC., Calgary (CA)

( * ) Notice: Subject to any disclaimer, the term of this patent is extended or adjusted under 35 U.S.C. 154(b) by 100 days.

(21) Appl. No.: 15/512,033

(22) PCT Filed: Sep. 18, 2015

(86) PCT No.: PCT/CA2015/050922
§ 371 (c)(1),
(2) Date: Mar. 16, 2017

(87) PCT Pub. No.: WO2016/041091
PCT Pub. Date: Mar. 24, 2016

(65) Prior Publication Data

US 2017/0298707 A1 Oct. 19, 2017

Related U.S. Application Data

(60) Provisional application No. 62/052,347, filed on Sep. 18, 2014.

(51) Int. Cl.
*E21B 34/08* (2006.01)
*E21B 34/10* (2006.01)
(Continued)

(52) U.S. Cl.
CPC ..... *E21B 34/10* (2013.01); *E21B 34/063* (2013.01); *E21B 34/103* (2013.01); *E21B 34/14* (2013.01); *E21B 2034/007* (2013.01)

(58) Field of Classification Search
CPC .. E21B 2034/007; E21B 34/063; E21B 34/08; E21B 34/10; E21B 34/103
See application file for complete search history.

(56) References Cited

U.S. PATENT DOCUMENTS 7,665,526 B2 2/2010 Turner et al.
2004/0020657 A1 2/2004 Patel
(Continued)

FOREIGN PATENT DOCUMENTS

WO 2009132462 11/2009
WO 2010086654 8/2010
(Continued)

OTHER PUBLICATIONS

International Searching Authority, The International Search Report and the Written Opinion of the International Searching Authority, or the Declaration, International Application No. PCT/CA2015/050922, Filed Sep. 18, 2015, 10 pages, Receiving Office—Canadian Intellectual Property Office.

*Primary Examiner* — Cathleen R Hutchins
(74) *Attorney, Agent, or Firm* — Richard D. Okimaw

(57) ABSTRACT

An apparatus and method for displacing a sleeve within a downhole tool wherein the apparatus comprises an outer mandrel, and a sleeve extending between first and second ends slidably located within the outer mandrel wherein the sleeve and mandrel form first, second and third annular chambers therebetween. The first annular chamber is in fluidic communication with an interior of the sleeve. The second annular chamber is in fluidic communication with an exterior of the mandrel. The third annular chamber is substantially sealed. The method comprises pressurizing the second chamber through bores extending through the sleeve and releasing the pressure within the second chamber so as to permit a vacuum within a third sealed chamber and a pressure from an exterior of the mandrel to pressurize a first
(Continued)

chamber to draw the sleeve towards a second end of the outer mandrel thereby uncovering the valve openings.

14 Claims, 6 Drawing Sheets

(51) Int. Cl.

| | |
|---|---|
| ***E21B 34/14*** | (2006.01) |
| ***E21B 34/06*** | (2006.01) |
| *E21B 34/00* | (2006.01) |

(56) References Cited

U.S. PATENT DOCUMENTS

| | | | | |
|---|---|---|---|---|
| 2010/0051291 | A1 | 3/2010 | Marcu | |
| 2011/0100643 | A1* | 5/2011 | Themig | E21B 34/102<br>166/373 |
| 2012/0111574 | A1* | 5/2012 | Desranleau | E21B 34/14<br>166/373 |
| 2013/0048298 | A1* | 2/2013 | Merron | E21B 34/14<br>166/373 |
| 2013/0168099 | A1* | 7/2013 | Themig | E21B 34/103<br>166/308.1 |
| 2013/0199800 | A1 | 8/2013 | Kellner et al. | |

FOREIGN PATENT DOCUMENTS

| | | |
|---|---|---|
| WO | 2011072367 | 6/2011 |
| WO | 2012037645 | 3/2012 |
| WO | 2012037646 | 3/2012 |

* cited by examiner

METHOD AND APPARATUS FOR CONTROLLING FLUID FLOW THROUGH A DOWN HOLE TOOL

BACKGROUND OF THE INVENTION

1. Field of Invention

The present invention relates a method and apparatus for isolating and controlling fluid flow within a zone of a subterranean formation.

2. Description of Related Art

In hydrocarbon production, it is frequently desirable to select which zone of the wellbore is to be opened for production from time to time for use in fracturing or the like. One method of isolating a zone is to provide valves within each zone which may be selectably opened to provide access to one or more of the zones as desired by a user. One conventional type of valve which may be utilized in such situations is a sleeve valve having an outer pipe with a plurality of ports therethrough which may be selectably covered or uncovered by a sliding sleeve within the pipe.

One current difficulty with sleeve valves is that the sleeve and string has a significant weight such that during run in, the weight of the string may cause it to rest along and drag on the bottom of the well bore or liner. Such weight causes significant friction thereby impeding run in or potentially damaging the string or valves.

Another difficulty is that some current valves may require a tool to be run into the valve to mechanically open the valve for operation. This can be a time consuming process.

SUMMARY OF THE INVENTION

According to a first embodiment of the present invention there is disclosed an apparatus for displacing a sleeve within a downhole tool. The apparatus comprises an outer mandrel, and a sleeve extending between first and second ends slidably located within the outer mandrel wherein the sleeve and mandrel form first, second and third annular chambers therebetween. The first annular chamber is in fluidic communication with an interior of the sleeve. The second annular chamber is in fluidic communication with an exterior of the mandrel. The third annular chamber is substantially sealed.

The second chamber may be in fluidic communication with the interior of the sleeve by ports extending radially through the sleeve. The first chamber may be in fluidic communication with the exterior of the mandrel by ports extending radially through the mandrel. The sleeve may be longitudinally secured within the mandrel by a shear pin. The apparatus may include a plurality of valve ports extending through said mandrel operable to be covered or uncovered by displacement of the sleeve.

According to a further embodiment of the present invention there is disclosed a method for opening a valve within a downhole tool. The method comprises, providing a sleeve within the mandrel operable to cover a plurality of valve openings forming first, second and third annular chambers between the mandrel and the sleeve. The method further comprises pressurizing the second chamber through bores extending through the sleeve fluidically connecting the second chamber and the interior of the sleeve so as to displace the sleeve towards a first end of the outer mandrel. The method further comprise releasing the pressure within the second chamber so as to permit a vacuum within a third sealed chamber and a pressure from an exterior of the mandrel to pressurize a first chamber to draw the sleeve towards a second end of the outer mandrel thereby uncovering the valve openings.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
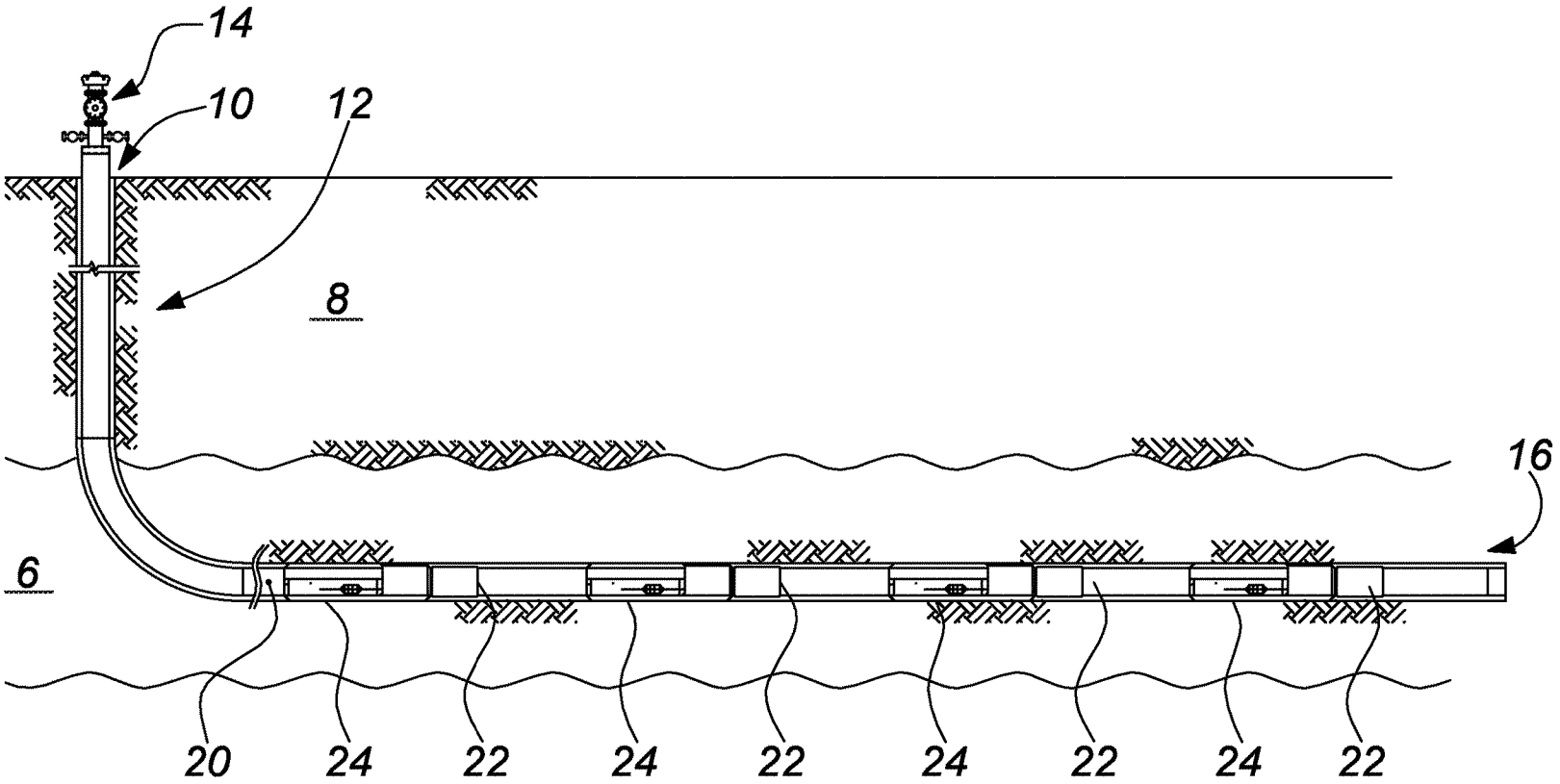
FIG. 1 is a cross-sectional view of a wellbore having a plurality of flow control valves according to a first embodiment of the present invention located therealong.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the production tubing 20 of the hydrocarbon well is formed of a plurality of alternating liner or casing 22 sections and an apparatus 24 for selectably permitting fluid flow between the interior of the liner and the formation. The valve bodies 24 are adapted to control fluid flow from the surrounding formation proximate to that valve body and may be located at predetermined locations to correspond to a desired production zone within the wellbore. In operation, between 8 and 100 valve bodies may be utilized within a wellbore although it will be appreciated that other quantities may be useful as well.

Figure 2:
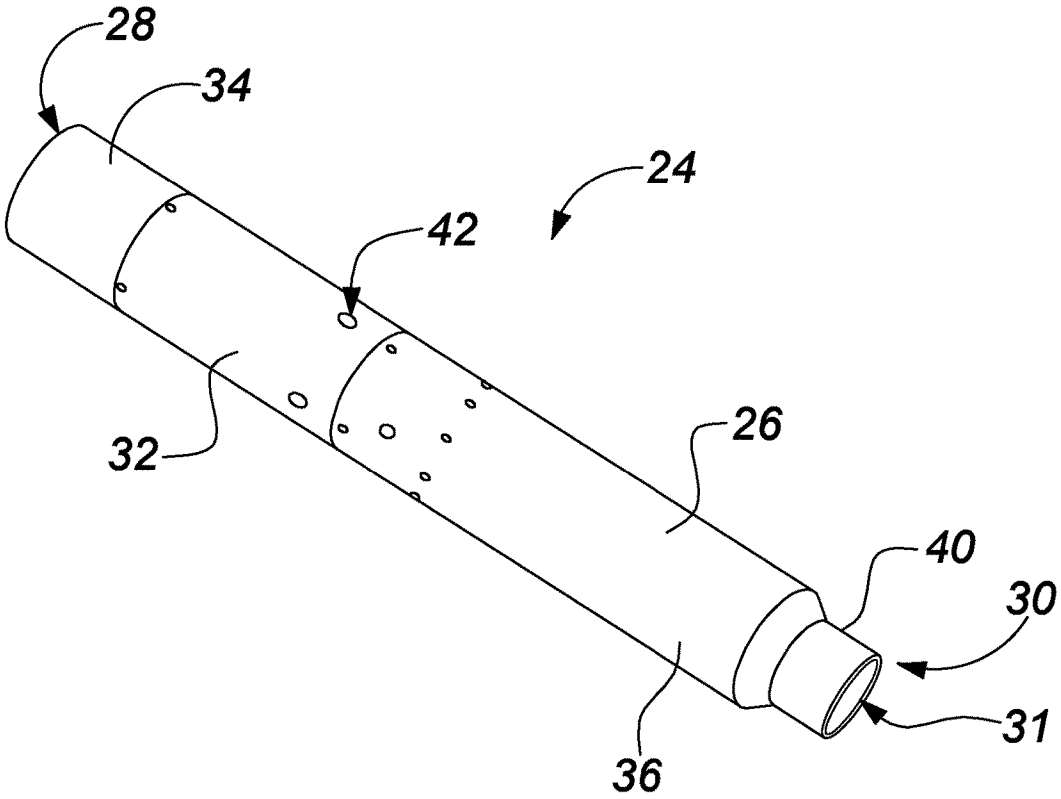
FIG. 2 is a perspective view of an apparatus for selectably isolating a subterranean formation according to a first embodiment of the present invention.

Turning now to FIG. 2, a perspective view of one apparatus 24 is illustrated. The apparatus 24 comprises a substantially elongate cylindrical outer casing or mandrel 26 extending between first and second ends 28 and 30, respectively and having a central passage 31 therethrough. The outer casing 26 may be formed of a central portion 32 and top and bottom caps, 34 and 36, respectively. The top cap 34 includes internal threading 38 (illustrated in FIG. 3) for connection to adjacent casing sections while the bottom cap includes outer threading 40 for connection to adjacent casing sections. The central portion 32 includes a plurality of ports 42 therethrough which may be of any conventionally known type. The outer casing 26 further includes a downstream oriented first annular casing ridge, 44, and second and third upstream oriented annular casing ridges, 46 and 48, respectively on an inner surface thereof. As illustrated, the first upstream annular ridge may be angled inwardly towards the central axis of the valve body 24.

Figure 3:
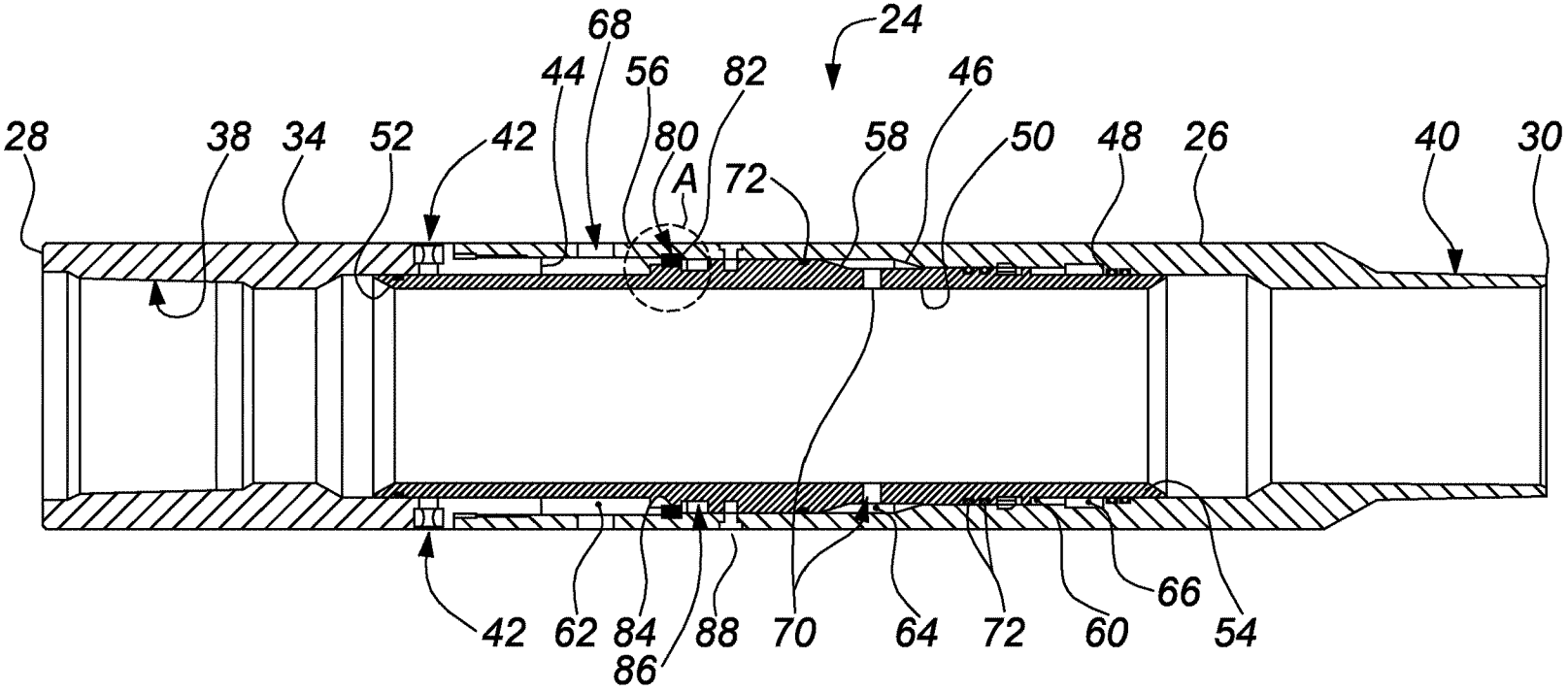
FIG. 3 is a cross sectional view of the apparatus of FIG. 2 as taken along the line 2-2 at a first or run in position.

Turning now to FIG. 3, the apparatus 24 includes a sleeve 50 slidably located within the outer casing 26. At the initial or run in position the sleeve 50 covers the ports 42. The sleeve extends between first and second ends, 52 and 54, respectively and includes a first upwardly oriented annular sleeve ridge 54 and second and third downwardly oriented annular sleeve ridges, 58 and 60, respectively on an outer surface thereof.

Figure 4:
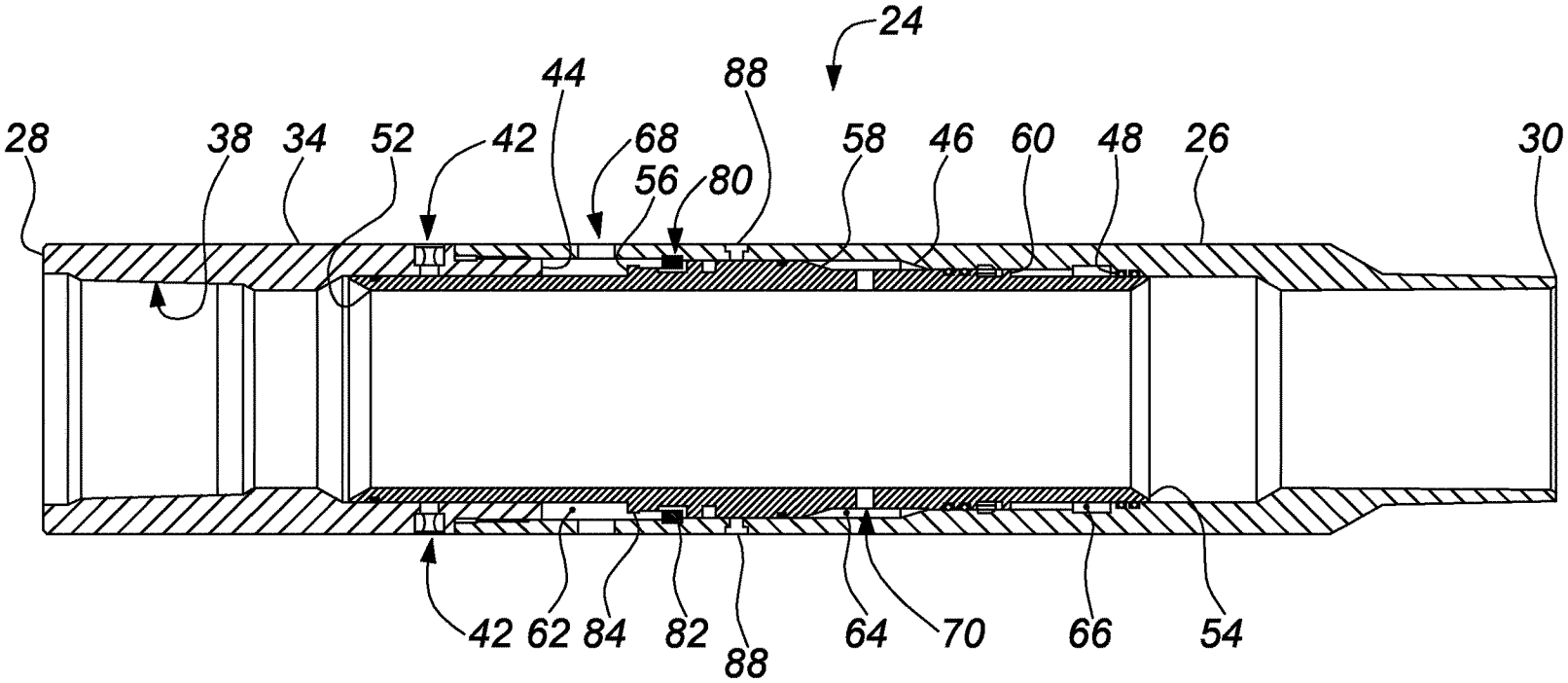
FIG. 4 is a cross sectional view of the apparatus of FIG. 2 as taken along the line 2-2 at a second or release position.
Figure 5:
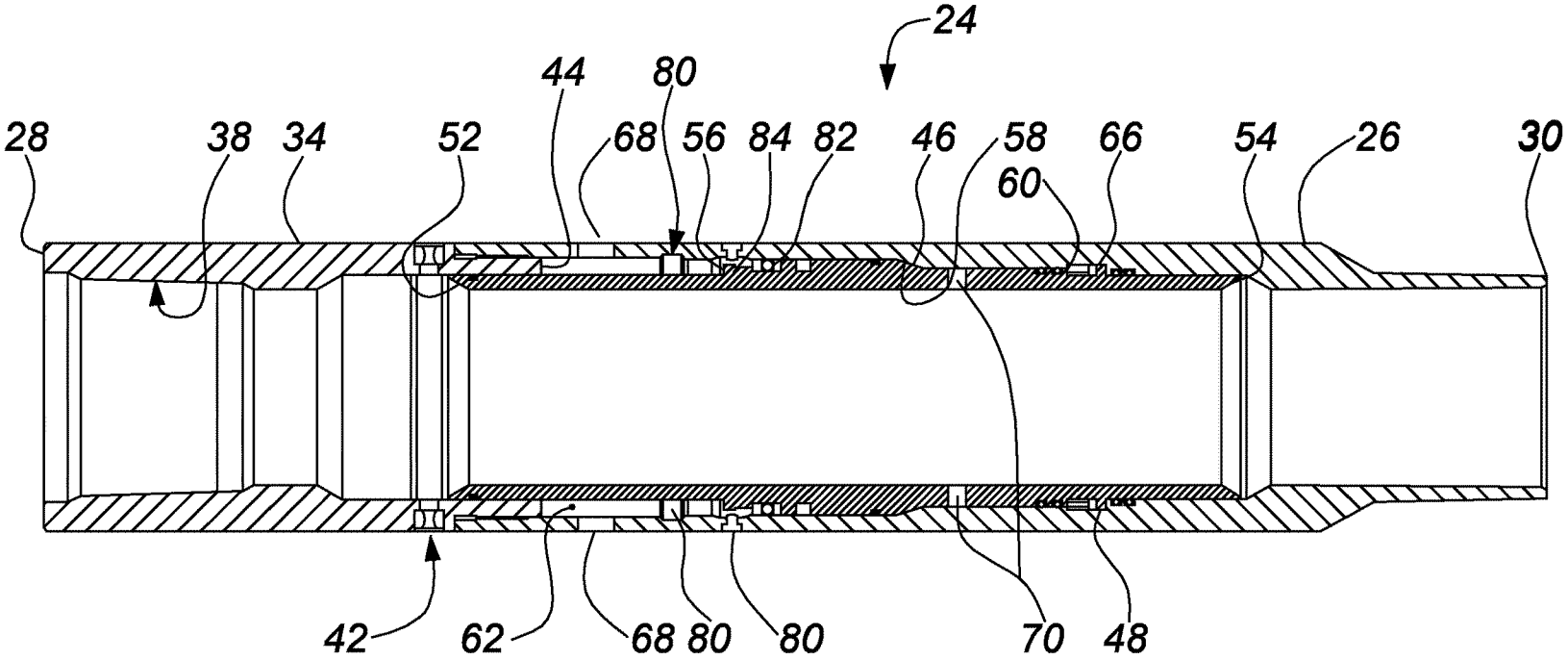
FIG. 5 is a cross sectional view of the apparatus of FIG. 2 as taken along the line 2-2 at a third or open position.

As illustrated in FIGS. 3 through 5, the first casing ridge 44 and the first annular ridge 56 form a first annular chamber 62 therebetween. Similarly, the second casing ridge 46 and second sleeve ridge 58 form a second annular chamber 64 therebetween and the third casing ridge 48 and third sleeve ridge 60 form a third annular chamber 66 therebetween. The first annular chamber 62 is in fluidic communication with an exterior of the outer casing 26 through casing ports 68 while the second annular chamber 64 is in fluidic communication with the central passage 31 of the apparatus through sleeve ports 70. The third annular chamber 66 is sealed at a pressure substantially corresponding to atmospheric pressure. Seals 72, as are commonly known isolate the first, second and third chambers from each other.

Figure 6:
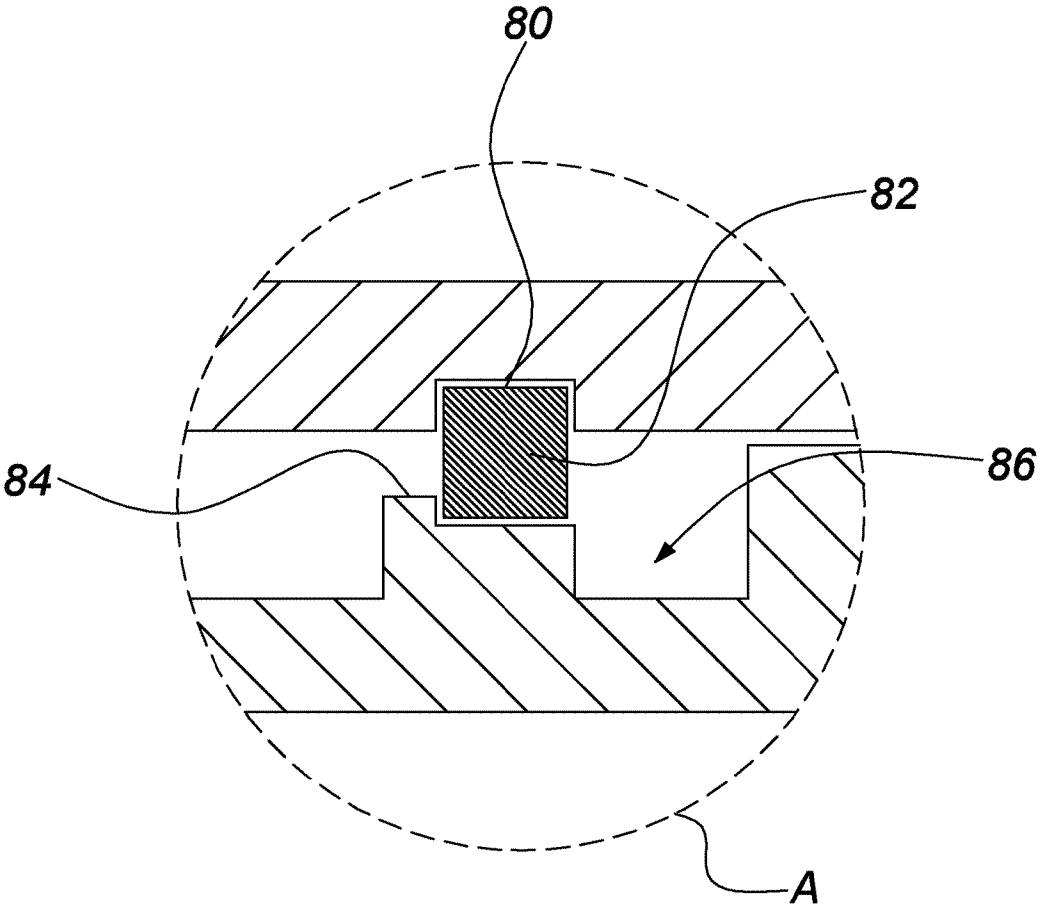
FIG. 6 is a detailed cross sectional view of a portion of the apparatus of FIG. 2 as indicated in FIG. 3 at A.

With reference to FIG. 4, the casing 26 includes an annular groove 80 therearound having an inwardly biased split ring 82 located therein. The sleeve 50 includes a shoulder 84 located upstream of the ring 82 sized to engage upon the ring in the run in position to prevent retraction of the sleeve 50 as illustrated in FIG. 3 and a release groove 86 downstream of the shoulder 84 as illustrated in greater detail in FIG. 6. The casing 26 also includes a plurality of shear pins 88 extending to the sleeve 50 to retain the sleeve 50 at the initial or run in position. Optionally, the sleeve 50 may also include other means for being engaged upon by a tool or the like as are commonly known.

In operation, the apparatus 24 is located in line in a tool or working string as illustrated in FIG. 1. During run in or while the valve is being positioned, the sleeve is at an initial position as illustrated in FIG. 3. In such position the shear pins 88 retain the sleeve at the initial position such that the sleeve covers the ports 42. In such a position the central passage 31 is isolated from the wellbore or exterior of the valve such that the pressure within the valve and tool string may be controlled to prevent or minimize contact of the valve on the bottom of the well bore. Once the valves 24 are located at their desired location, the production tubing 20 may be pressurized to fill the second annular chamber 64 through the sleeve ports 70. This increased pressure within the second annular chamber 64 will not be balanced against any other pressure in the apparatus 24 and when this pressure reaches a desired level the shear pins 88 will be sheared permitting the sleeve to retract to the second or release position as illustrated in FIG. 4. It will be appreciated that the desired release pressure may be selected as desired by the user by the selection of the shear pins such as between 2 to 4 times the well bore pressure, by way of non-limiting example.

Turning now to FIG. 4, after the shear pins 88 have been sheared, the sleeve 50 is pushed upstream by the pressure within the second annular chamber 64. The ring 82 is retained in its position relative to the casing 26 until it is permitted to retract into the release groove as illustrated in FIG. 4 at which point it will then be disengaged from the annular grove 80. Thereafter, the pressure within the production tubing 20 may be decreased thereby releasing the pressure within the second annular chamber 64. Once the pressure within well bore enters the first annular chamber 62 through the casing ports 68. The pressure within the first annular chamber 62 forces the sleeve 50 in a downward direction until the ports 42 are uncovered as illustrated in FIG. 5. Additionally, the third annular chamber 66 which is sealed at atmospheric pressure also draws the sleeve 50 in a downward direction due to the vacuum within this chamber relative to the wellbore. It will be appreciated that in such operation, all the valves within a well bore may be opened at the same time and at a common pressure. Optionally, a tension spring may be provided in place of the third annular chamber to provide an additional drawing force to the sleeve 50 in a downward direction.

While specific embodiments of the invention have been described and illustrated, such embodiments should be considered illustrative of the invention only and not as limiting the invention as construed in accordance with the accompanying claims.

What is claimed is:

1. An apparatus for controlling fluid flow within a downhole tool comprising:

an outer mandrel extending between a first end and a second end; and a sleeve slidably located within said outer mandrel, wherein said sleeve and mandrel form first, second and third annular chambers located radially therebetween, wherein said sleeve includes an inner surface open to a passage through said apparatus along an entire length of the sleeve, wherein said first annular chamber is in fluidic communication with an exterior of said mandrel and defined between a ridge on the outer surface of said sleeve and a ridge on the inner surface of said mandrel, wherein said second annular chamber is in fluidic communication with an interior of said sleeve, and wherein said third annular chamber is substantially sealed.

2. The apparatus of claim 1 wherein said second chamber is in fluidic communication with said interior of said sleeve by ports extending radially through said sleeve.

3. The apparatus of claim 1 wherein said first chamber is in fluidic communication with said exterior of said mandrel by ports extending radially through said mandrel.

4. The apparatus of claim 1 wherein said sleeve is longitudinally secured within said mandrel by at least one shear pin.

5. The apparatus of claim 1 wherein said apparatus includes a plurality of valve ports extending through said mandrel operable to be covered or uncovered by displacement of said sleeve.

6. The apparatus of claim 1 further comprising a ring disposed between said mandrel and said sleeve adapted to retain said sleeve at a position relative to said mandrel during run in of said mandrel and sleeve.

7. The apparatus of claim 6 wherein said ring comprises a split ring.

8. The apparatus of claim 7 wherein said split ring is radially inwardly biased.

9. The apparatus of claim 8 wherein said mandrel includes an annular groove on an inner surface thereof adapted to retain said split ring therein during said run in.

10. The apparatus of claim 9 wherein said sleeve include a shoulder towards said first end relative to said split ring adapted to engage upon said split ring and prevent movement of said sleeve towards said second end during run in of said mandrel and sleeve.

11. The apparatus of claim 10 wherein said sleeve includes a relief groove towards said second end relative to said split ring adapted to permit said split ring to be retracted thereinto and out of engagement with said annular groove of said mandrel upon said sleeve being shifted towards said first end.

12. A method for controlling fluid flow within a downhole tool comprising:

providing a mandrel locatable inline within a well string;

slidably locating a sleeve within said mandrel operable to cover a plurality of valve openings wherein said sleeve and said mandrel form first, second and third annular chambers therebetween;

wherein said sleeve includes an inner surface open to a passage through said apparatus;

pressurizing said second chamber through ports extending thereinto from an interior of said sleeve so as to shift said sleeve towards a first end thereof and shear at least one shear pin therebetween; and releasing a pressure within said second chamber so as to permit a vacuum within said third chamber and a pressure from an exterior of the mandrel to pressurize said first chamber through bores extending through said mandrel to said first chamber to draw the sleeve towards a second end of the outer mandrel thereby uncovering the valve openings.

13. The method of claim 12 further comprising providing a split ring engaged within an annular groove in an interior surface of said mandrel and upon a shoulder extending from an outer surface of said sleeve.

14. The method of claim 13 wherein said split ring is retracted into a relief groove upon said sleeve being shifted towards said first end of said mandrel and out of engagement with said annular groove.

* * * * *